US009076339B2

(12) United States Patent
Hawkes et al.

(10) Patent No.: US 9,076,339 B2
(45) Date of Patent: Jul. 7, 2015

(54) FACILITATING VEHICLE MERGING UTILIZING ROAD MARKERS

(71) Applicant: QUALCOMM Incorporated, San Diego, CA (US)

(72) Inventors: Philip Michael Hawkes, Warrimoo (AU); Gregory Gordon Rose, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 19 days.

(21) Appl. No.: 13/769,136

(22) Filed: Feb. 15, 2013

(65) Prior Publication Data

US 2014/0232560 A1 Aug. 21, 2014

(51) Int. Cl.

| | |
|---|---|
| ***G08G 1/09*** | (2006.01) |
| ***G08G 1/16*** | (2006.01) |
| ***G08G 1/07*** | (2006.01) |

(Continued)

(52) U.S. Cl.

CPC ..... *G08G 1/167* (2013.01); *G08G 1/0112* (2013.01); *G08G 1/0116* (2013.01); *G08G 1/0133* (2013.01); *G08G 1/0145* (2013.01); *G08G 1/02* (2013.01); *G08G 1/04* (2013.01); *G08G 1/07* (2013.01); *G08G 1/075* (2013.01); *G08G 1/095* (2013.01); *G08G 1/164* (2013.01)

(58) Field of Classification Search

CPC ..... B31B 7/00; B60B 7/02; B60C 5/08; B60N 2/504; B60N 2/506; B60N 2/544; B60Q 9/008; B60R 11/00; B60T 13/40; B60T 13/403; B60T 15/36; B60T 8/1831; B61K 9/08; B61L 13/04; B61L 23/005

USPC ..... 340/905, 435, 901–903, 425.5, 436, 340/907, 932, 933, 937, 909–910, 438

See application file for complete search history.

(56) References Cited

U.S. PATENT DOCUMENTS

| | | | |
|---|---|---|---|
| 3,750,099 | A | 7/1973 | Proctor |
| 3,872,423 | A | 3/1975 | Yeakley |

(Continued)

FOREIGN PATENT DOCUMENTS

| | | | |
|---|---|---|---|
| GB | 2303906 | A | 3/1997 |
| GB | 2341712 | A | 3/2000 |

(Continued)

OTHER PUBLICATIONS

Eliasson J., et al., "Towards road surface monitoring: Experiments and technical challenges", Control Applications, (CCA) & Intelligent Control, (ISIC), 2009 IEEE, IEEE, Piscataway, NJ, USA, Jul. 8, 2009, pp. 655-659, XP031542868, ISBN: 978-1-4244-4601-8 abstract figure 4 p. 655, paragraph II.A p. 656, paragraph II.A-D p. 657, paragraph II.3 p. 659, paragraph IV.

(Continued)

*Primary Examiner* — Daniel Previl

(74) *Attorney, Agent, or Firm* — Blakely Sokoloff Taylor & Zafman

(57) ABSTRACT

Disclosed is an apparatus, system, and method to utilize a plurality of road markers to aid a vehicle in merging into a lane. The lane that the merging vehicle desires to merge into is determined. Further, the position of the merging vehicle is determined. Target vehicles are then notified about the merging vehicle utilizing the plurality of road markers.

63 Claims, 4 Drawing Sheets

(51) Int. Cl.

| | |
|---|---|
| ***G08G 1/095*** | (2006.01) |
| *G08G 1/01* | (2006.01) |
| *G08G 1/02* | (2006.01) |
| *G08G 1/04* | (2006.01) |

(56) References Cited

U.S. PATENT DOCUMENTS

| | | | | |
|---|---|---|---|---|
| 3,938,080 | A | 2/1976 | Hulme | |
| 5,134,393 | A | 7/1992 | Henson | |
| 5,552,767 | A | 9/1996 | Toman | |
| 5,673,039 | A | 9/1997 | Pietzsch et al. | |
| 5,760,686 | A | 6/1998 | Toman | |
| 5,897,270 | A * | 4/1999 | Barel | 404/1 |
| 6,115,652 | A * | 9/2000 | Sato et al. | 701/28 |
| 6,559,774 | B2 | 5/2003 | Bergan et al. | |
| 6,900,740 | B2 | 5/2005 | Bloomquist et al. | |
| 7,019,669 | B1 | 3/2006 | Carr | |
| 7,021,857 | B2 | 4/2006 | Van Der Poel | |
| 7,025,525 | B2 * | 4/2006 | Van Der Poel | 404/1 |
| 7,170,548 | B2 * | 1/2007 | Ishikawa | 348/148 |
| 7,397,351 | B1 * | 7/2008 | Rubin et al. | 340/435 |
| 7,708,493 | B2 | 5/2010 | Jung et al. | |
| 7,755,510 | B2 | 7/2010 | Bilimoria et al. | |
| 7,859,431 | B2 | 12/2010 | Peddie et al. | |
| 7,877,187 | B2 | 1/2011 | Hori et al. | |
| 8,154,424 | B2 | 4/2012 | Selevan | |
| 8,373,578 | B1 | 2/2013 | Sikora et al. | |
| 2003/0063015 | A1 | 4/2003 | Ebner et al. | |
| 2004/0127231 | A1 | 7/2004 | Dor et al. | |
| 2004/0246144 | A1 | 12/2004 | Siegel et al. | |
| 2005/0270175 | A1 | 12/2005 | Peddie et al. | |
| 2006/0193691 | A1 | 8/2006 | Gonzalez et al. | |
| 2007/0067100 | A1 * | 3/2007 | Matsumoto | 701/208 |
| 2007/0124306 | A1 | 5/2007 | Nelson | |
| 2007/0211463 | A1 | 9/2007 | Chevalier et al. | |
| 2007/0213088 | A1 | 9/2007 | Sink | |
| 2008/0042815 | A1 | 2/2008 | Breed et al. | |
| 2009/0009089 | A1 | 1/2009 | Burkett | |
| 2010/0156668 | A1 | 6/2010 | Lee | |
| 2010/0201267 | A1 | 8/2010 | Bourquin et al. | |
| 2011/0006912 | A1 | 1/2011 | Sheardown et al. | |
| 2011/0068950 | A1 * | 3/2011 | Flaherty | 340/905 |
| 2011/0084854 | A1 | 4/2011 | Johnson | |
| 2011/0153742 | A1 | 6/2011 | Sloop et al. | |
| 2011/0164922 | A1 * | 7/2011 | Moxlow et al. | 404/16 |
| 2011/0199231 | A1 | 8/2011 | Loiselle et al. | |
| 2012/0194353 | A1 | 8/2012 | Groves | |
| 2012/0249341 | A1 | 10/2012 | Brown et al. | |
| 2013/0013179 | A1 | 1/2013 | Lection et al. | |
| 2013/0038461 | A1 | 2/2013 | Hawkes et al. | |
| 2013/0113618 | A1 | 5/2013 | Flanagan et al. | |

FOREIGN PATENT DOCUMENTS

| | | | |
|---|---|---|---|
| WO | 8807560 | A1 | 10/1988 |
| WO | 9604632 | A1 | 2/1996 |
| WO | 9835328 | A2 | 8/1998 |
| WO | 0217266 | A2 | 2/2002 |
| WO | 2006091932 | A2 | 8/2006 |

OTHER PUBLICATIONS

Samardzija D., et al., "Road Nail: Intelligent road marking system testbed", Vehicular Networking Conference (VNC), 2010 IEEE, IEEE, Piscataway, NJ, USA, Dec. 13, 2010 ; pp. 134-138, XP031857811, ISBN: 978-1-4244-9526-9 abstract figures 1-3, 9 p. 134, paragraphs I,II p. 135, paragraph III.A p. 136, paragraph C p. 137, paragraph IV.

Dragan Samardzija, et al; "Road Nail: Intelligent Road Marking System Testbed", Vehicular Networking Conference (VNC), 2010 IEEE, IEEE, Piscataway, NJ, USA, Dec. 13, 2010, pp. 134-138, XP031857811.

Notification of Transmittal of International Search Report and the Written Opinion of the International Searching Authority in a corresponding PCT Application No. PCT/US2014/015576 dated May 13, 2014.

* cited by examiner

FACILITATING VEHICLE MERGING UTILIZING ROAD MARKERS

BACKGROUND

1. Field

The present invention relates generally to an apparatus, system, and method to facilitate vehicle merging utilizing road markers.

2. Relevant Background

When a vehicle wishes to merge into a lane, particularly in heavy traffic, it is desirable to inform the drivers of vehicles already in the lane such that those drivers can ensure there is sufficient space for the merging vehicle to enter into the lane.

In today's implementations, a driver is expected to command his/her vehicle to flash turn signals shortly before they wish to merge, and drivers of vehicles already in the lane need to be on the lookout for merging vehicles. This unfortunately places a great burden on the drivers of vehicles already in the lane. Moreover, the driver of the merging vehicle is only aware of the traffic conditions in their immediate vicinity and does not have access to information to make optimal decisions about when to safely merge.

At locations where two roads meet, traffic lights can be used to dynamically control traffic merging from one road to the other. Similarly, "Stop" signs, "Yield" signs (called "Give Way" signs in some countries) and roundabouts (sometimes called turning circles) provide static rules for allowing the merging of traffic in and out of lanes.

Unfortunately, these existing mechanisms, such as merely utilizing turn signals and static signs, do not facilitate merging in an efficient and safe manner.

SUMMARY

Embodiments of the invention may relate to an apparatus, system, and method to utilize a plurality of road markers to aid a vehicle in merging into a lane. The lane that the merging vehicle desires to merge into is determined. Further, the position of the merging vehicle is determined. Target vehicles are then notified about the merging vehicle utilizing the plurality of road markers.

DETAILED DESCRIPTION

The word "exemplary" or "example" is used herein to mean "serving as an example, instance, or illustration." Any embodiment described herein as "exemplary" or "example" is not necessarily to be construed as preferred or advantageous over other embodiments.

Figure 1:
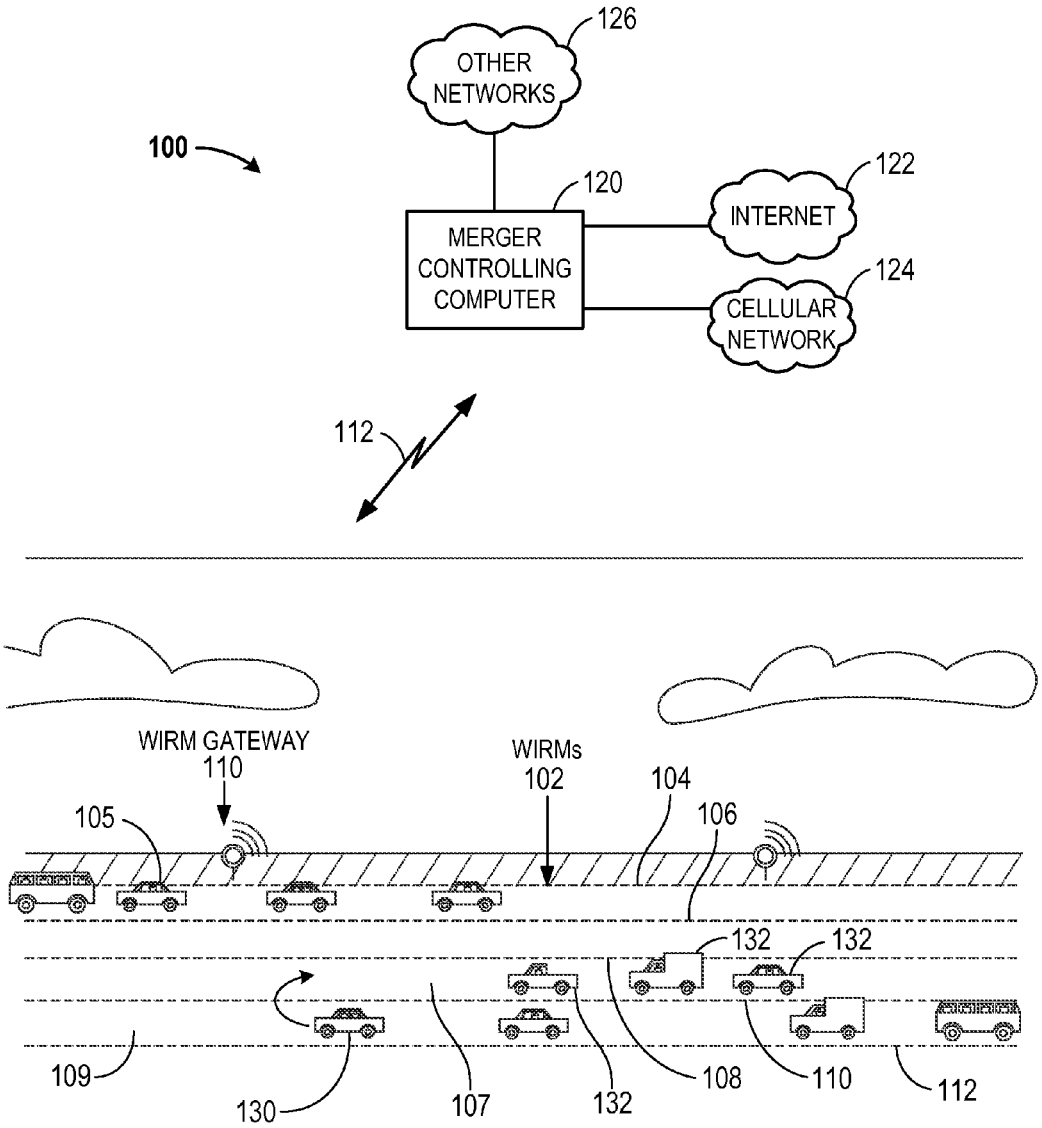
FIG. 1 is a diagram illustrating a system in which embodiments of the invention may be practiced

With reference to FIG. 1, FIG. 1 is a diagram illustrating a system in which embodiments of the invention may be practiced. In one embodiment, a vehicle merging system 100 having a plurality of wireless intelligent road markers (WIRMs) 102 in cooperation with a merger controlling computer 120 and WIRM gateways 110 to aid a vehicle in merging into a lane will be hereinafter described. Vehicle merging system 100 utilizing WIRMs 102 may have the ability to: communicate with the merger controlling computer 120; be aware of the positions and speeds of vehicles 105; and communicate with vehicles 105. The vehicle merging system 100 may therefore utilize WIRMs 102 and the merger controlling computer 120. Also, in some embodiments, WIRM gateways 110 may also be utilized.

In one embodiment, vehicle merging system 100 may implement a method utilizing a plurality of WIRMs 102 and the merger controlling computer 120 to aid a vehicle in merging into a lane. As will be described in more detail, this method may include: determining the lane that a merging vehicle desires to merge into; determining the position of the merging vehicle; and notifying target vehicles about the merging vehicle utilizing the plurality of WIRMs.

As can be seen in FIG. 1, a highway is illustrated having a plurality of lanes 109 in which a plurality of vehicles 105 (e.g., cars, trucks, etc.) and other vehicles are driving. As a particular example, each of the lanes 109 may have a corresponding group of WIRMs 104, 106, 108, 110, and 112 that may be utilized to emit lights, flashes, patterns, etc., to warn drivers about vehicles that are about to merge into lanes in front of them, as well as other possible reasons to merge. The WIRMs 102 may communicate messages 112 to the merger controlling computer 120 and with one another. The WIRMs 102 may also utilize WIRM gateways 110 to transmit messages 112 to the merger controlling computer 120. The merger controlling computer 120 may further be connected to the Internet 122, a cellular network 124, as well as other networks 126.

As one particular example, the vehicle merging system 100 may determine that a vehicle desires to merge into a lane. For example, the vehicle merging system 100 may determine the position of a merging vehicle 130 including the lane 107 that the merging vehicle 130 wants to merge into. As can be seen in FIG. 1, merging vehicle 130 wants to merge into the lane 107 to its right (e.g., see arrow). The vehicle merging system 100 may identify target vehicles 132 in the adjacent lane that need to be made aware of the merging vehicle 130 and may notify the target vehicles 132 about the merging vehicle 130 by utilizing the plurality of WIRMs 102. In particular, WIRMs 108 and 110 may be utilized to alert the target vehicles 132 of the merging vehicle's 130 intent to merge into their lane 107 (e.g., by flashing colors). Thus, the vehicle merging system 100 may communicate to the drivers of the target vehicles 132 of the merging vehicle's 130 intent to merge into their lane. In this way, the vehicle merging system 100 may regulate lane changes to optimize traffic flow and safety.

Figure 2:
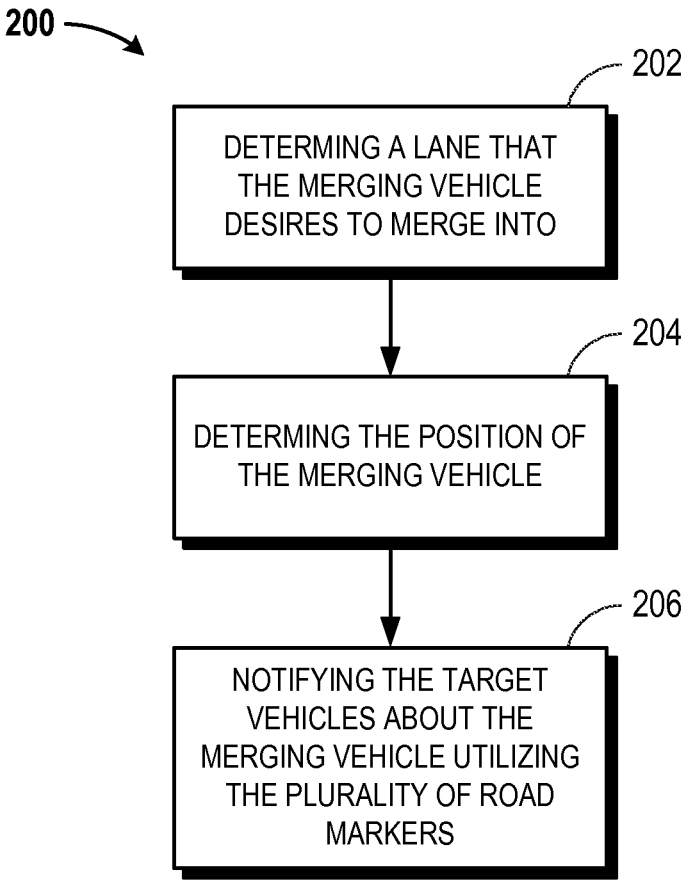
FIG. 2 is a flow diagram that illustrates a process of notifying target vehicles about a merging vehicle utilizing a plurality of road markers.

With brief additional reference to FIG. 2, in one embodiment, a method 200 may be implemented in which a lane that the merging vehicle 130 desires to merge into is determined. (Block 202). Next, the position of the merging vehicle 130 is determined. (Block 204). Further, target vehicles 132 are notified about the merging vehicle's 130 intent to merge into their lane by utilizing a plurality of road markers 108 and 110. (Block 206).

For example, in one embodiment, determining the lane that the merging vehicle 130 desires to merge into may include the merger controlling computer 120 receiving a message 112 (e.g., a wireless signal) from the merging vehicle 130 indicating the direction in which the merging vehicle 130 intends to merge. Message 112 may come directly from the merging vehicle 130 or from transmissions from the WIRMs 112 and/or the WIRM gateway 110. Message 112 may be generated based upon a driver actuating an indicator of their vehicle, such as, a lever or a button. For example, a particular implementation may be the turn lever in the merging vehicle 130 being turned left or right (down/up) by the driver which then turns on the left/right blinker light of the vehicle. This message 112 may be sent as a wireless signal to the merging controlling computer 120 to let the merging controlling computer 120 know that the merging vehicle 130 is planning to merge (e.g., right) into another lane such that the merging controlling computer 120 can notify the target vehicles 132 about the merging vehicle 130 utilizing the WIRMs 108 and 110. As an example, the message 112 may be a specialized RF signal for the vehicle merging system 100 or a standard cellphone call signal through a cellular network 124 to the merging controlling computer 120. It should be appreciated that the turn message 112 from the vehicle 130 may be sent through the WIRMs 102, the WIRM gateway 110, and/or through the cellular network 124 to the merging controlling computer 120.

Further, the position of the merging vehicle 130 may be determined by the merging controlling computer 120 receiving a position message 112 indicating the position of the merging vehicle 130. This position message 112 may by calculated by the merging vehicle 130 itself (e.g., based upon a GPS position device in the vehicle) or by a position message 112 for the merging vehicle 130 estimated by the WIRMs 110 and 112 and transmitted by the WIRMs and/or the WIRM gateway 110.

The target vehicles 132 may be notified about the merging vehicle 130 merging into their lane by utilizing the plurality of WIRMs 108 and 110. For example, WIRMs 108 and 110 may have their presentation changed in front of the target vehicles 132 to provide a visual indication that the merging vehicle 130 is merging lanes. For example, changing the presentation of the WIRMs 108 and 110 may include emitting a light with a particular intensity and with a particular color. In one particular example, WIRMs 108 and 110 may emit a yellow light indicating that a car is about to merge in front of them. Further, the light may be emitted at a particular frequency to provide a strobe pattern to indicate a desirable speed to the drivers of the target vehicles 132. As an example, WIRMs 108 and 110 may be commanded by the merging controlling computer 120 to emit light at a particular frequency associated with a desired speed so that the WIRMs 108 and 110 emit light in a strobe pattern such that if the target vehicles 132 are traveling at the desired speed, then the strobe pattern appears static to the drivers of the vehicles. In this way, if a target vehicle 132 is traveling at the desired speed, the strobe pattern appears to be static to the driver of the target vehicle. On the other hand, if the target vehicle 132 is traveling above the desired speed, the strobe pattern appears to be coming towards the driver of the vehicle indicating that the target vehicle should slow down. Conversely, if the target vehicle 132 is traveling below the desired speed, the strobe pattern appears to be moving away from the driver of the target vehicle.

Figure 3:
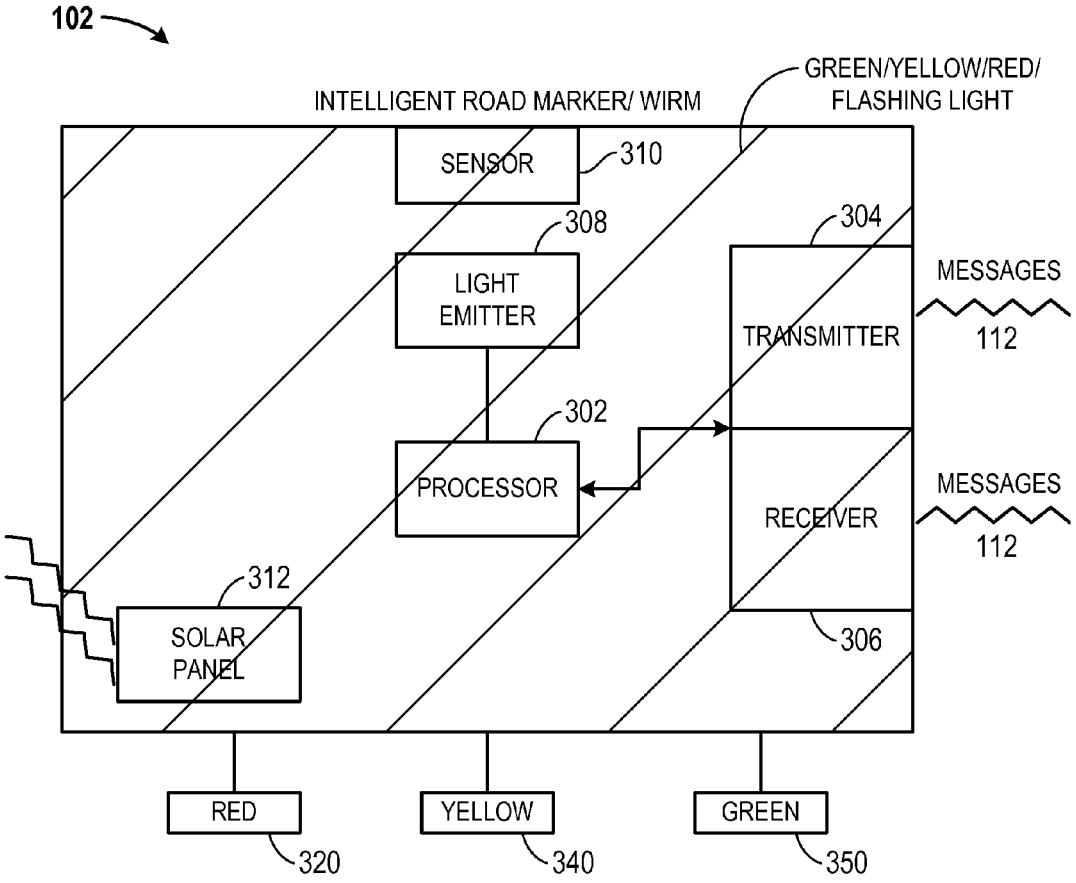
FIG. 3 is a diagram of a WIRM.

With brief additional reference to FIG. 3, an example of the components of a WIRM 102, according to one embodiment of the invention, will be described. A WIRM 102 may be used to communicate messages 112 with other WIRMs 102, WIRM gateways 110, the merger controlling computer 120, and to and from vehicles 105. WIRMs 102 may comprise a light emitter 308 (e.g., an LED) to emit different light colors (e.g. red 320, yellow 340, green 350, etc.) at particular frequencies; a transmitter 304 to transmit messages 112; a receiver 304 to receive messages 112; and a processor 302. Processor 302 may be used to: command the light emitter 308 to emit a light at a particular frequency and in a particular color based upon a received message 112 (e.g., from the merger controlling computer 120); and to command the transmitter 304 to transmit messages 112 to other WIRMs, WIRM gateway 110, and to the merger controlling computer 120.

WIRMs 102 may include a sensor 310 to estimate the lane of adjacent vehicles, the speed of adjacent vehicles, and the position/location of adjacent vehicles. Sensor 310 may be an optical or a motion vibration sensor to determine the speed and position of the merging vehicles 130 and/or target vehicles 132. Processor 302 may command transmitter 304 to transmit the position and speed messages 112 of the merging vehicle 130 and target vehicles 132 to other WIRMs 102, as well as, through WIRM gateway 110 to the merger controlling computer 120 or directly to the merging controlling computer 120. For example, a WIRM transmitter 302 may transmit a message 112 to the merger controlling computer 120 indicating a lane the merging vehicle desires to move into as well as the position and speed of the merging vehicle. The WIRM receiver 306 may receive a message 112 from merger controlling computer 120 indicating a color and frequency at which to flash to notify target vehicles about a merging vehicle. The WIRM 102 under control of processor 302 may flash at the designated color and frequency. For example, particular WIRMs associated with particular lanes may receive messages from the merger controlling computer 120 to flash based upon the positions and speeds of the merging vehicle 130 and the target vehicles 132. Additionally, WIRMs 102 may include a solar panel 312 in order to provide power to the WIRM.

Figure 4:
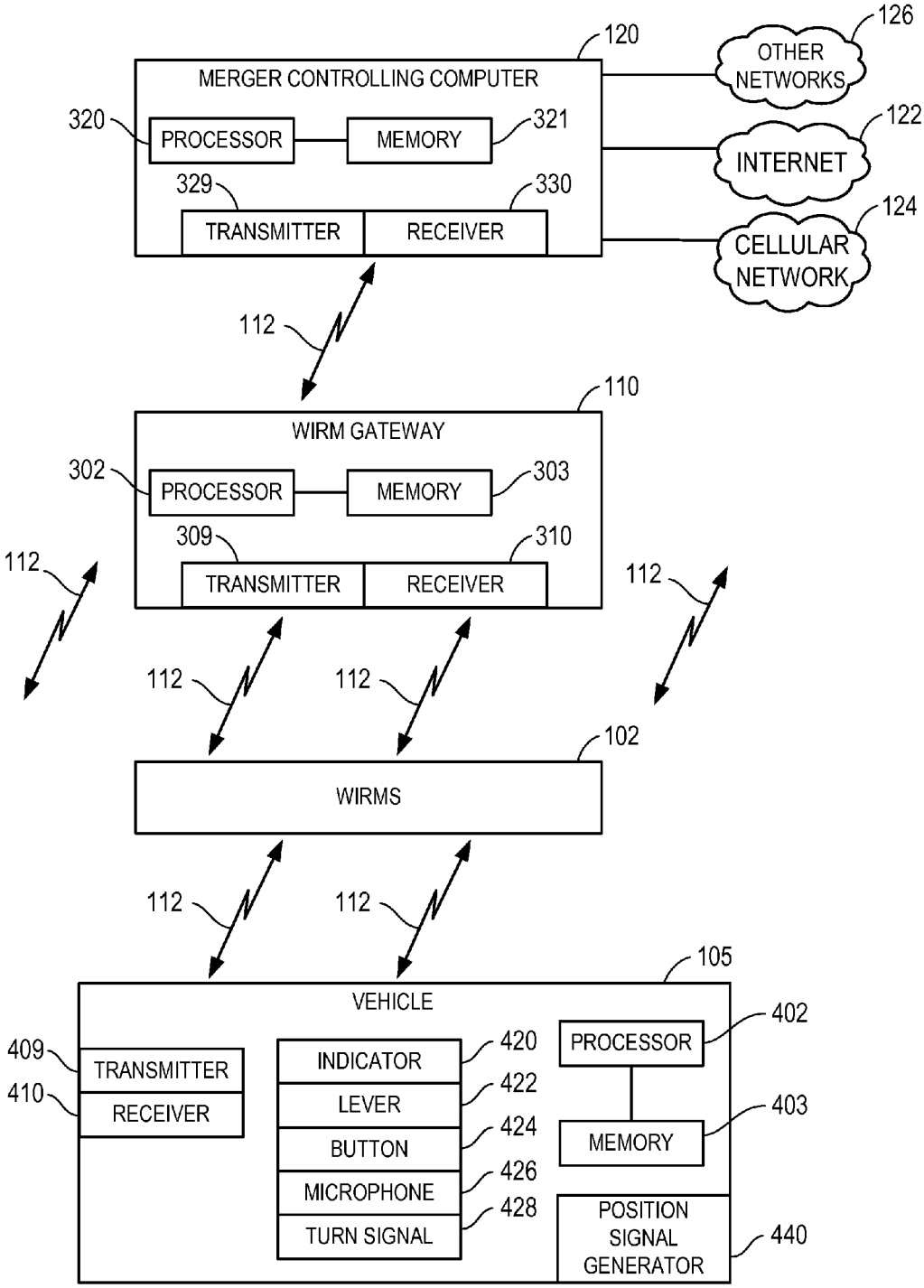
FIG. 4 is a diagram illustrating components of a merging controlling computer, a WIRM gateway, and a vehicle.

With brief additional reference to FIG. 4, an example of the components of the merging controlling computer 120, the WIRM gateway 110, and a vehicle 105 that may be utilized by the vehicle merging system 100, according to one embodiment of the invention, will be described. For example, WIRM gateway 110 may include a processor 302, a memory 303, a transmitter 309, and a receiver 310 to implement particular functions. Transmitter 309 may transmit messages 112 to WIRMs 102, vehicles 105, and to merger controlling computer 120 and likewise may receive messages 112 via receiver 310 from WIRMs 102, vehicles 105 and from the merging controlling computer 120.

Similarly, merger controlling computer 120 may include a processor 320, a memory 321, as well as an interface (e.g., transmitter 329 and receiver 330) to implement particular functions. Merger controlling computer 120 may be connected to the Internet 122, cellular networks 124, and other networks 126. Merger controlling computer 120 may receive messages 112 from WIRM gateway 110, and/or WIRMs 102, and/or directly from vehicles 105, as previously described. Likewise, merger controlling computer 120 may transmit messages 112 to WIRM gateway 110 (such that WIRM gateway 110 can pass on messages to WIRMs 102), and/or directly to WIRMs 102, and/or directly to vehicles 105. As previously described, these types of messages 112 from the merging controlling computer 120 may be to WIRMs 102 to notify target vehicles about merging vehicles utilizing the WIRMs 102 to provide visual indications, such as, flashing lights in particular colors and at particular frequencies to notify the target vehicles about the merging vehicle.

Further, vehicles 105 may include components such as a processor 402 and a memory 403 to implement various functions. A vehicle may also include a transmitter 409 and a receiver 410 to transmit and receive messages 112 from the WIRMs 102, WIRM gateway 110, and merging controlling computer 120. Additionally components of vehicle 400 may include an indicator 420, such as: a turn lever 422 to specify turning left or right; a turning button 424 to specify turning left or right; a microphone 426 to receive a sound from the driver to specify turning left or right; as well as a turn signal light 428 that flashes to let target vehicles know whether the vehicle is turning left or right. Further, the vehicle 105 may include a position signal generator 440 that utilizes GPS software to determine the position of the vehicle. The position signal generator 440 may determine the position of the vehicle that is transmitted as a message 112 via transmitter 409 to WIRMs 102, WIRM gateway 110 and/or to merging controlling computer 120.

A particular implementation of the vehicle merging system 100 will be hereinafter described.

As an example, with reference to FIG. 1 and the other figures, the vehicle merging system 100 may determine that a merging vehicle 130 desires to move (e.g., right—see arrow) into another lane 107. The vehicle merging system 100 may determine the position of the merging vehicle 130 and the lane that the merging vehicle 130 wants to merge into. Further, the vehicle merging system 100 may identify target vehicles 132 that should be made aware of the merging vehicle 130 and may notify the target vehicles 132 about the merging vehicle 130 by utilizing a plurality of WIRMs 108 and 110. As an example, WIRMs 108 and 110 may be commanded by the merger controlling computer 120 to flash with a particular color and at a particular frequency such that the target vehicles 132 are notified to slow down and to allow the merging of the merging vehicle 130. In this way, the vehicle merging system 100 may regulate lane changes to optimize traffic flow and to optimize safety.

In one embodiment, determining the lane that the merging vehicle 130 desires to merge into includes the merging controlling computer 120 receiving a message 112 from the merging vehicle 130 indicating the direction in which the merging vehicle 130 is merging. This message 112 may be generated based upon a driver actuating an indicator 420 of the vehicle such as a turn lever 422 or a turn button 422. As an example, a driver may turn the turn lever 422 in the vehicle (down/up or left/right) which turns on the left/right blinker light on the vehicle. The turn message 112 may be sent as a specific RF signal to the merging controlling computer 120 to let the merging controlling computer 120 know that the merging vehicle 130 is planning to merge into another lane 109 such that the merging controlling computer 120 can transmit a flashing message 112 to the WIRMs 108 and 110 to notify the target vehicles 132 about the merging vehicle 130. In one embodiment, the merging controlling computer 120 may command that the WIRMs 108 and 110 flash a particular color at a particular frequency to notify the target vehicles 132 about the merging vehicle 130 and specify a safe speed for them to allow the merging of the merging vehicle 130.

The RF signal for the merging message 112 indicating the merging may be a specialized signal for the vehicle merging system 100 transmitted by the WIRMs 102, the WIRM gateway 110, or from the vehicle itself. Also, a standard cellphone call from the merging vehicle 130 (e.g., via transmitter 409) may transmit the merging message 112 through a cellular network 124 to the merging controlling computer 120. This may be a specialized component of the vehicle or a typical wireless device.

Further, as one example, WIRMs 110 and 112 adjacent to the merging vehicle 130 via sensor 310 may identify the turn signal of the merging vehicle 130 and may transmit the merging message 112 to the merging controlling computer 120 instead of or in addition to the merging vehicle 130 itself.

As another example, instead of or in addition to a physical actuator (e.g., a turn lever 422 or turn button 424), a microphone 426 of the merging vehicle 130 may receive a sound from the driver (e.g., "I am merging right") which may be used to generate the merging message 112 that is transmitted to the merger controlling computer 120 to indicate that merging vehicle 130 is planning to merge lanes. Additionally, the WIRMs 110 and 112 may themselves, based upon sensors 310, determine that the vehicle is merging to the right (e.g. based on the movement of the vehicle) and may transmit the merging message 112 to the merger controlling computer 120.

In another embodiment, in determining a lane that the merging vehicle should merge into, the merger controlling computer 120 may determine the lane based upon the physical characteristics of the lane. For example, this may include determining that the merging vehicle is coming down an on-ramp onto a freeway, or where the lane ends shortly, or where heavy traffic is ahead, or where an accident is ahead, or where road work is ahead, etc. Based upon this, the merger controlling computer 120 may automatically transmit flash messages 112 to the WIRMs of the lane of interest to flash lights to indicate to vehicles in the lane that there is a reason to merge to the left or the right to another lane due to an upcoming event.

Further, as previously described, determining the position of the merging vehicle 130 may include the merger controlling computer 120 receiving a position message 112 indicating the position of the merging vehicle 130. This position message 112 may come from a position signal generator 440 of the merging vehicle 130 itself (e.g., based upon a GPS position device in the vehicle) or the position message 112 for the merging vehicle 130 may be generated by the WIRMs 110 and 112 based upon utilization of their sensors 310, as previously described. Further, as previously described, the position message 112 from the merging vehicle 130 itself may be transmitted through the WIRMs 102 and/or the WIRM gateway 110 to the merger controlling computer 120 or via a wireless link through a cellular network 124 to the merger controlling computer 120.

Further, in one embodiment, notifying the target vehicles 132 about the merging vehicle 130 utilizing the plurality WIRMs 108 and 110 may include changing the presentation of the WIRMs 108 and 110 in front of the target vehicles 132 to provide a visual indication that the merging vehicle 130 is merging lanes. This may be based upon a flash signal 112 transmitted by the merger controlling computer 120, as previously described. For example, changing the presentation of the WIRMs 108 and 110 may include emitting a light from the light emitter 308 at a particular frequency and in a particular color (e.g., yellow). Further, emitting the light at the particular frequency may further indicate a desirable speed to the drivers of the target vehicles 132. In particular, the lights may be emitted at a particular frequency to generate a strobe pattern to indicate to the drivers of the target vehicles a safe speed to allow the merging vehicle 130 to merge safely.

Additionally, in one embodiment, the target vehicles 132 may be notified about the merging vehicle 130 by the merging controlling computer 120 transmitting a notification message 112 to the target vehicles 132 themselves notifying the target vehicles about the merging vehicle. For example, the notification message 112 may be an audio signal that is transmitted to the speaker of the target vehicle 132 or a visual communication. As a particular example, the notification message 112 may be a voice message to the target vehicle 132 telling the driver that the vehicle to the left or right of them is about to merge. The notification may also be a visual indication on a screen of driver's vehicle, such as a display screen showing vehicles on the freeway lanes around the driver's vehicles, and, in particular, providing a flashing indication of the merging vehicle 130 that is about to merge. It should be appreciated that these notification messages 112 may be transmitted based upon wireless signals from the merger controlling computer 120 and/or from the WIRM gateway 110 and/or from the WIRMs 102. Additionally, the merger controlling computer 120 may notify the target vehicles 132 and the merging vehicle 130 with such notification messages 112 via a cellular network 124 and/or through the Internet 122.

As an additional embodiment, the presentation of the WIRMs 110 and 112 in front of the merging vehicle may be changed to provide a visual indication that it is safe or not same for the merging vehicle 130 to merge lanes. This may be based upon a flash signal 112 transmitted by the merger controlling computer 120, as previously described. Presentation of the WIRMs 110 and 112 in front of the merging vehicle 130 may include emitting a light at a particular frequency and in a particular color. For example, the WIRMs 110 and 112 may display a green color (indicating it is safe to merge) at a particular frequency to indicate a desirable speed to the driver of the merging vehicle 130 such that the merging vehicle maintains a suitable speed and is provided authorization to merge. However, as another example, the WIRMs 110 and 112 in front of the merging vehicle 130 may be changed to provide an indication that it is not safe for the merging vehicle 130 to merge lanes, such as by flashing red lights.

As yet another example, the merging vehicle 130 may be an automated vehicle in which the driver does not control speed, steering, or merging of the vehicle. In this example, determining the lane that the merging vehicle 130 desires to merge into may further include the merger controlling computer 120 receiving a message 112 from the automated merging vehicle indicating the direction that the merging vehicle 130 would like to merge into—in which driver input is not utilized. Therefore, the merger message 112 generated by the automated vehicle may indicate that it is an automated vehicle and may further indicate the particular direction in which the automated vehicle desires to merge lanes.

In a further implementation, the merger controlling computer 120 may track and store the amount of lanes merged into and out of by vehicles. For example, a vehicle may be weaving into and out of lanes very often, abusing the system, and obstructing traffic flow. This is disadvantageous for other drivers. In this implementation, the merger controlling computer 120 can notify the merging vehicle to stop changing lanes so often. Additionally, in certain fee-based systems, the merging vehicle that is weaving into and out of lanes to often can be charged extra fees.

It should be appreciated that the various described implementations of the invention utilizing WIRMs 102, the WIRM gateway 110, and the merger controlling computer 120 are just various examples of implementations. For example, in one implementation WIRM gateways 110 are not utilized at all and only the WIRMs 102 and the merger controlling computer 120 are utilized. In another implementation, the merging controlling computer 120 and the WIRM gateways 110 may not be utilized at all. In this implementation, the WIRMs 102 themselves will determine the lane that the merging vehicle 130 desires to merge into; determine the position of the merging vehicle 130; and notify the target vehicles 132 about the merging vehicle 130 by flashing particular colors, at particular frequencies, to let the target vehicles 132 know about the merging vehicle 130 and a proper safe speed to be at. As another example of possible implementations, the WIRMs 102 may not utilize wireless communications, but may be wired to one another, and to the WIRM gateways 110, in order to wirelessly communicate with the merger controlling computer 120.

It should be appreciated that embodiments of the invention previously described may be implemented in conjunction with the execution of instructions (e.g. stored in memories) by the processors (e.g., the processors of the WIRMs 102, WIRM gateways 110, and the merger controlling computer 120) and/or other circuitry and/or other devices. Particularly, this circuitry including but not limited to processors, may operate under the control of a program, routine, or the execution of instructions to execute methods or processes in accordance with embodiments of the invention. For example, such a program may be implemented in firmware or software (e.g., stored in memory and/or other locations) and may be implemented by processors and/or other circuitry. Further, it should be appreciated that the terms processor, microprocessor, circuitry, controller, etc., refer to any type of logic or circuitry capable of executing logic, commands, instructions, software, firmware, functionality, etc. Further, the WIRMs 102, WIRM gateways 110, and the merger controlling computer 120 may communicate via one or more communication links that are based on or otherwise supported by any suitable wireless communication technology or any suitable type of wired technology.

It should be appreciated that when the devices are mobile or wireless devices that they may communicate via one or more wireless communication links through a wireless network that are based on or otherwise support any suitable wireless communication technology. For example, in some aspects the wireless device and the other devices may associate with a network including a wireless network. In some aspects the network may comprise a body area network or a personal area network (e.g., an ultra-wideband network). In some aspects the network may comprise a local area network or a wide area network. A wireless device may support or otherwise use one or more of a variety of wireless communication technologies, protocols, or standards such as, for example, CDMA, TDMA, OFDM, OFDMA, WiMAX, and Wi-Fi. Similarly, a wireless device may support or otherwise use one or more of a variety of corresponding modulation or multiplexing schemes. A wireless device may thus include appropriate components (e.g., air interfaces) to establish and communicate via one or more wireless communication links using the above or other wireless communication technologies. For example, a device may comprise a wireless transceiver with associated transmitter and receiver components (e.g., a transmitter and a receiver) that may include various components (e.g., signal generators and signal processors) that facilitate communication over a wireless medium. As is well known, a mobile wireless device may therefore wirelessly communicate with other mobile devices, cell phones, other wired and wireless computers, Internet web-sites, etc.

The techniques described herein can be used for various wireless communication systems such as Code Division Multiple Access (CDMA), Time division multiple access (TDMA), Frequency Division Multiple Access (FDMA), Orthogonal Frequency-Division Multiple Access (OFDMA), Single Carrier FDMA (SC-FDMA) and other systems. The terms "system" and "network" are often used interchangeably. A CDMA system can implement a radio technology such as Universal Terrestrial Radio Access (UTRA), CDMA2000, etc. UTRA includes Wideband-CDMA (W-CDMA) and other variants of CDMA. CDMA2000 covers Interim Standard (IS)-2000, IS-95 and IS-856 standards. A TDMA system can implement a radio technology such as Global System for Mobile Communications (GSM). An OFDMA system can implement a radio technology such as Evolved Universal Terrestrial Radio Access; (Evolved UTRA or E-UTRA), Ultra Mobile Broadband (UMB), Institute of Electrical and Electronics Engineers (IEEE) 802.11 (Wi-Fi), IEEE 802.16 (WiMAX), IEEE 802.20, Flash-OFDM®, etc. Universal Terrestrial Radio Access (UTRA) and E-UTRA are part of Universal Mobile Telecommunication System (UMTS). 3GPP Long Term Evolution (LTE) is an upcoming release of UMTS that uses E-UTRA, which employs OFDMA on the downlink and SC-FDMA on the uplink. UTRA, E-UTRA, UMTS, LTE and GSM are described in documents from an organization named "3rd Generation Partnership Project" (3GPP). CDMA2000 and UMB are described in documents from an organization named "3rd Generation Partnership Project 2" (3GPP2).

The teachings herein may be incorporated into (e.g., implemented within or performed by) a variety of apparatuses (e.g., devices). For example, one or more aspects taught herein may be incorporated into a phone (e.g., a cellular phone), a personal data assistant ("PDA"), a tablet, a mobile computer, a laptop computer, a tablet, an entertainment device (e.g., a music or video device), a headset (e.g., headphones, an earpiece, etc.), a user I/O device, a computer, a wired computer, a fixed computer, a desktop computer, a server, a point-of-sale device, an entertainment device, a set-top box, or any other suitable device. These devices may have different power and data requirements.

In some aspects a wireless device may comprise an access device (e.g., a Wi-Fi access point) for a communication system. Such an access device may provide, for example, connectivity to another network (e.g., a wide area network such as the Internet or a cellular network) via a wired or wireless communication link. Accordingly, the access device may enable another device (e.g., a Wi-Fi station) to access the other network or some other functionality.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software as a computer program product, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a web site, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method of utilizing a plurality of road markers to aid a vehicle in merging into a lane comprising:

determining the lane that the merging vehicle desires to merge into;

determining a position of the merging vehicle; and notifying target vehicles about the merging vehicle utilizing the plurality of road markers, the notifying further comprising transmitting commands to the plurality of road markers.

2. The method of claim 1, wherein determining the lane that the merging vehicle desires to merge into further comprises receiving a message from the merging vehicle indicating the direction in which the merging vehicle is merging.

3. The method of claim 2, wherein the message from the merging vehicle indicating the direction in which the merging vehicle is merging is generated based upon a driver actuating an indicator.

4. The method of claim 3, wherein the indicator is at least one of a lever, a button, or a microphone to receive a sound.

5. The method of claim 1, wherein determining the lane that the merging vehicle desires to merge into further comprises determining the lane based upon the physical characteristics of the lane.

6. The method of claim 1, wherein determining the position of the merging vehicle further comprises receiving a position message indicating the position of the merging vehicle.

7. The method claim 1, wherein notifying the target vehicles about the merging vehicle utilizing the plurality of road markers further comprises changing the presentation of the road markers in front of the target vehicles to provide a visual indication that the merging vehicle is merging lanes.

8. The method claim 7, wherein changing the presentation of the road markers includes emitting a light at a particular frequency and in a particular color.

9. The method claim 8, wherein emitting the light at the particular frequency further indicates a desirable speed to the drivers of the target vehicles.

10. The method claim 1, further comprising changing the presentation of the road markers in front of the merging vehicle to provide a visual indication that it is safe for the merging vehicle to merge lanes.

11. The method claim 10, wherein changing the presentation of the road markers includes emitting a light at a particular frequency and in a particular color.

12. The method claim 11, wherein emitting the light at the particular frequency further indicates a desirable speed to the driver of the merging vehicle.

13. The method claim 10, further comprising changing the presentation of the road markers in front of the merging vehicle to provide a visual indication that it is not safe for the merging vehicle to merge lanes.

14. The method claim 1, wherein notifying the target vehicles about the merging vehicle further comprises commanding a wireless communication to the target vehicles notifying the target vehicles about the merging vehicle.

15. The method claim 14, wherein the notification is at least one of an audio or visual communication.

16. The method claim 1, wherein determining the lane that merging vehicle desires to merge into further comprises receiving a message from the merging vehicle indicating the direction in which the merging vehicle is merging in which the merging vehicle is an automated vehicle and driver input is not utilized.

17. The method claim 1, wherein a merger controlling computer tracks and stores an amount of lane merges by vehicles.

18. A merger controlling computer to command a plurality of road markers to aid a vehicle in merging into a lane comprising:

an interface; and a processor to control operations including:

determining the lane that the merging vehicle desires to merge into;

determining a position of the merging vehicle; and transmitting commands through the interface to the plurality of road markers to notify target vehicles about the merging vehicle.

19. The merger controlling computer of claim 18, wherein determining the lane that the merging vehicle desires to merge into further comprises receiving a message from the merging vehicle indicating the direction in which the merging vehicle is merging.

20. The merger controlling computer of claim 19, wherein the message from the merging vehicle indicating the direction in which the merging vehicle is merging is generated based upon a driver actuating an indicator.

21. The merger controlling computer of claim 20, wherein the indicator is at least one of a lever, a button, or a microphone to receive a sound.

22. The merger controlling computer of claim 18, wherein determining the lane that the merging vehicle desires to merge into further comprises determining the lane based upon the physical characteristics of the lane.

23. The merger controlling computer of claim 18, wherein determining the position of the merging vehicle further comprises receiving a position message indicating the position of the merging vehicle.

24. The merger controlling computer of claim 18, wherein notifying the target vehicles about the merging vehicle further comprises transmitting commands to the road markers in front of the target vehicles to provide a visual indication that the merging vehicle is merging lanes.

25. The merger controlling computer of claim 24, wherein commanding the road markers in front of the target vehicles to provide a visual indication further comprises commanding the road markers to emit a light at a particular frequency and in a particular color.

26. The merger controlling computer of claim 25, wherein emitting the light at the particular frequency further indicates a desirable speed to the drivers of the target vehicles.

27. The merger controlling computer of claim 18, further comprising transmitting commands to the road markers in front of the merging vehicle to provide a visual indication that it is safe for the merging vehicle to merge lanes.

28. The merger controlling computer of claim 27, wherein providing the visual indication that it is safe for the merging vehicle to merge lanes includes commanding the road markers in front of the merging vehicle to emit a light at a particular frequency and in a particular color.

29. The merger controlling computer of claim 18, further comprising transmitting commands to the plurality of road markers in front of the merging vehicle to provide a visual indication that it is not safe for the merging vehicle to merge lanes.

30. The merger controlling computer of claim 18, wherein notifying the target vehicles about the merging vehicle further comprises commanding a wireless communication to the target vehicles notifying the target vehicles about the merging vehicle.

31. The merger controlling computer of claim 30, wherein the notification is at least one of an audio or visual communication.

32. The merger controlling computer of claim 18, wherein determining the lane that merging vehicle desires to merge into further comprises receiving a message from the merging vehicle indicating the direction in which the merging vehicle is merging in which the merging vehicle is an automated vehicle and driver input is not utilized.

33. The merger controlling computer of claim 18, wherein the merger controlling computer further tracks and stores an amount of lane merges by vehicles.

34. A merger controlling computer to command a plurality of road markers to aid a vehicle in merging into a lane comprising:

means for determining the lane that the merging vehicle desires to merge into;

means for determining a position of the merging vehicle; and means for notifying target vehicles about the merging vehicle utilizing the plurality of road markers, the means for notifying further comprising means for transmitting commands to the plurality of road markers.

35. The merger controlling computer of claim 34, wherein determining the lane that the merging vehicle desires to merge into further comprises means for receiving a message from the merging vehicle indicating the direction in which the merging vehicle is merging.

36. The merger controlling computer of claim 35, wherein the message from the merging vehicle indicating the direction in which the merging vehicle is merging is generated based upon a driver actuating an indicator.

37. The merger controlling computer of claim 36, wherein the indicator is at least one of a lever, a button, or a microphone to receive a sound.

38. The merger controlling computer of claim 34, wherein determining the lane that the merging vehicle desires to merge into further comprises means for determining the lane based upon the physical characteristics of the lane.

39. The merger controlling computer of claim 34, wherein determining the position of the merging vehicle further comprises means for receiving a position message indicating the position of the merging vehicle.

40. The merger controlling computer of claim 34, wherein notifying the target vehicles about the merging vehicle utilizing the plurality of road markers further comprises means for changing the presentation of the road markers in front of the target vehicles to provide a visual indication that the merging vehicle is merging lanes.

41. The merger controlling computer of claim 40, wherein changing the presentation of the road markers includes emitting a light at a particular frequency and in a particular color.

42. The merger controlling computer of claim 41, wherein emitting the light at the particular frequency further indicates a desirable speed to the drivers of the target vehicles.

43. The merger controlling computer of claim 34, further comprising means for changing the presentation of the road markers in front of the merging vehicle to provide a visual indication that it is safe for the merging vehicle to merge lanes.

44. The merger controlling computer of claim 43, wherein changing the presentation of the road markers includes emitting a light at a particular frequency and in a particular color.

45. The merger controlling computer of claim 44, wherein emitting the light at the particular frequency further indicates a desirable speed to the driver of the merging vehicle.

46. The merger controlling computer of claim 34, further comprising means for changing the presentation of the road markers in front of the merging vehicle to provide a visual indication that it is not safe for the merging vehicle to merge lanes.

47. The merger controlling computer of claim 34, wherein notifying the target vehicles about the merging vehicle further comprises means for commanding a wireless communication to the target vehicles notifying the target vehicles about the merging vehicle.

48. The merger controlling computer of claim 47, wherein the notification is at least one of an audio or visual communication.

49. A computer program product comprising:

a computer-readable medium comprising code for:

determining a lane that a merging vehicle desires to merge into;

determining a position of the merging vehicle; and notifying target vehicles about the merging vehicle utilizing a plurality of road markers, the notifying further comprising transmitting commands to the plurality of road markers.

50. The computer program product of claim 49, wherein determining the lane that the merging vehicle desires to merge into further comprises code for receiving a message from the merging vehicle indicating the direction in which the merging vehicle is merging.

51. The computer program product of claim 50, wherein the message from the merging vehicle indicating the direction in which the merging vehicle is merging is generated based upon a driver actuating an indicator.

52. The computer program product of claim 51, wherein the indicator is at least one of a lever, a button, or a microphone to receive a sound.

53. The computer program product of claim 49, wherein determining the lane that the merging vehicle desires to merge into further comprises code for determining the lane based upon the physical characteristics of the lane.

54. The computer program product of claim 49, wherein determining the position of the merging vehicle further comprises code for receiving a position message indicating the position of the merging vehicle.

55. The computer program product of claim 49, wherein notifying the target vehicles about the merging vehicle utilizing the plurality of road markers further comprises code for changing the presentation of the road markers in front of the target vehicles to provide a visual indication that the merging vehicle is merging lanes.

56. The computer program product of claim 55, wherein changing the presentation of the road markers includes emitting a light at a particular frequency and in a particular color.

57. The computer program product of claim 56, wherein emitting the light at the particular frequency further indicates a desirable speed to the drivers of the target vehicles.

58. The computer program product of claim 49, further comprising code for changing the presentation of the road markers in front of the merging vehicle to provide a visual indication that it is safe for the merging vehicle to merge lanes.

59. The computer program product of claim 58, wherein changing the presentation of the road markers includes emitting a light at a particular frequency and in a particular color.

60. The computer program product of claim 59, wherein emitting the light at the particular frequency further indicates a desirable speed to the driver of the merging vehicle.

61. The computer program product of claim 49, further comprising code for changing the presentation of the road markers in front of the merging vehicle to provide a visual indication that it is not safe for the merging vehicle to merge lanes.

62. The computer program product of claim 49, wherein notifying the target vehicles about the merging vehicle further comprises code for commanding a wireless communication to the target vehicles notifying the target vehicles about the merging vehicle.

63. The computer program product of claim 62, wherein the notification is at least one of an audio or visual communication.

* * * * *